US008414140B2

(12) United States Patent
Chang

(10) Patent No.: US 8,414,140 B2
(45) Date of Patent: Apr. 9, 2013

(54) WRITING INSTRUMENT PROVIDING ILLUMINATION

(75) Inventor: Kuo-Cheng Chang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 293 days.

(21) Appl. No.: 12/906,131

(22) Filed: Oct. 17, 2010

(65) Prior Publication Data

US 2012/0087112 A1 Apr. 12, 2012

(30) Foreign Application Priority Data

Oct. 12, 2010 (TW) ..... 99134737 A

(51) Int. Cl.
*F21L 26/00* (2006.01)

(52) U.S. Cl. ..... 362/118; 362/656; 362/649

(58) Field of Classification Search ..... 362/118, 362/120, 203, 656, 649; 434/391
See application file for complete search history.

(56) References Cited

U.S. PATENT DOCUMENTS

| | | | | | |
|---|---|---|---|---|---|
| 1,482,603 | A | * | 2/1924 | Faulhaber | 439/336 |
| 1,987,158 | A | * | 1/1935 | Quaglia | 362/118 |
| 5,335,150 | A | * | 8/1994 | Huang | 362/118 |
| 5,673,996 | A | * | 10/1997 | Ducker | 362/118 |

* cited by examiner

*Primary Examiner* — Sharon Payne
(74) *Attorney, Agent, or Firm* — Altis Law Group, Inc.

(57) ABSTRACT

A writing instrument providing illumination includes a penholder, a pen core, a solid state lighting source module, and a rotating plate. The rotating plate connects to one end of the penholder. The solid state lighting source module is embedded in the rotating plate which can rotate to a specific angle. A battery providing electrical energy to the solid state lighting source module is arranged inside the penholder. When the rotating plate is turned to a position perpendicular to the penholder the solid state lighting source module is turned on and when the rotating plate is turned to a position adjacent to the penholder the solid state lighting source module is turned off.

8 Claims, 4 Drawing Sheets

WRITING INSTRUMENT PROVIDING ILLUMINATION

TECHNICAL FIELD

The disclosure relates to writing instruments, and particularly to a writing instrument providing illumination with a solid state lighting source module.

DESCRIPTION OF THE RELATED ART

Light emitting diodes' (LEDs) many advantages, such as high luminosity, low operational voltage, low power consumption, compatibility with integrated circuits, easy driving, long term reliability, and environmental friendliness have promoted their wide use as a light source. Now, light emitting diodes are commonly applied in environmental lighting.

Most commonly used writing instruments are difficult to use in dark environments, such as during a slide presentation.

Therefore, it is desirable to provide a writing instrument which can overcome the described limitations.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present writing instrument. Moreover, in the drawings, like reference numerals designate corresponding parts throughout the views.

DETAILED DESCRIPTION

Embodiments of a writing instrument providing illumination as disclosed are described in detail here with reference to the drawings.

Figure 1:
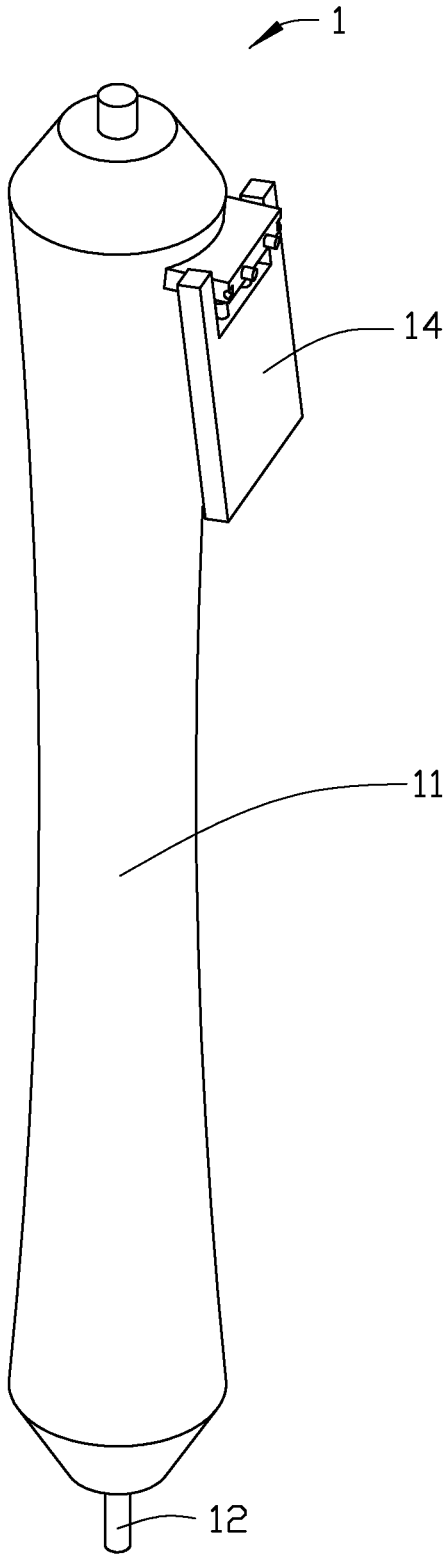
FIG. 1 is a schematic view of a writing instrument providing illumination in accordance with a first embodiment.
Figure 2:
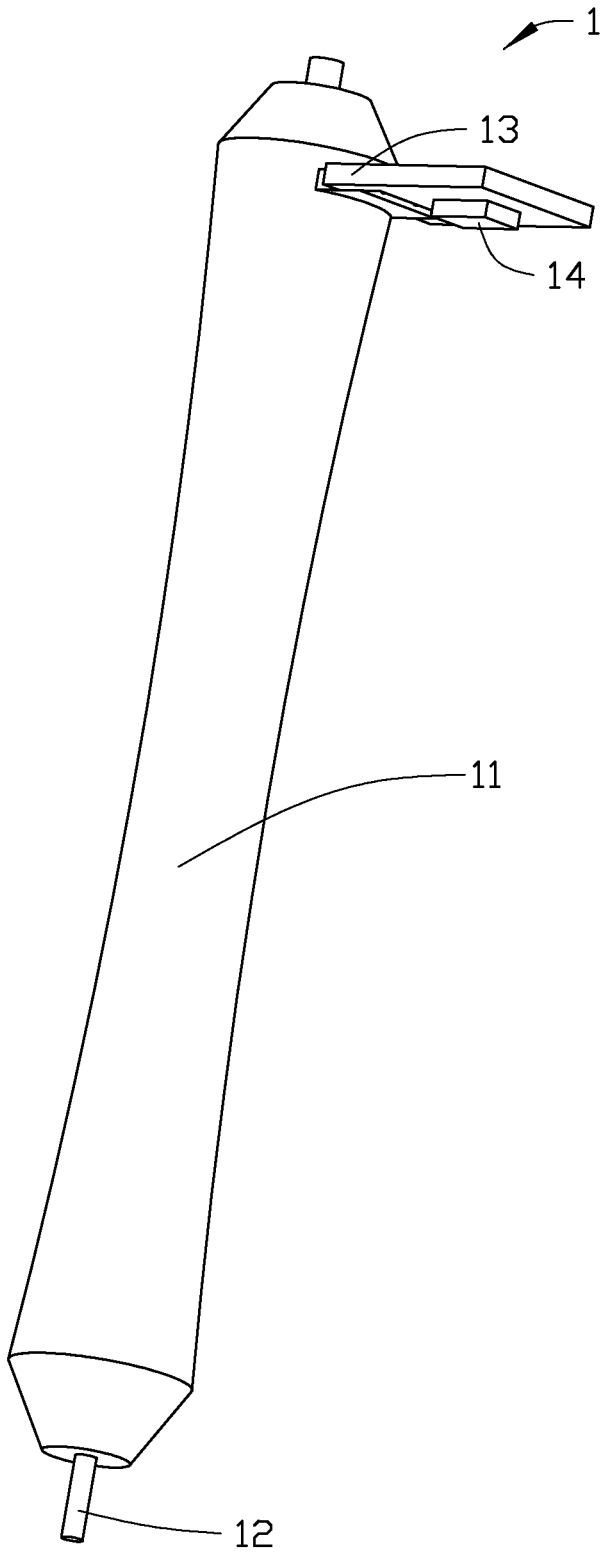
FIG. 2 is a view similar to FIG. 1, with a solid state lighting source module of the writing instrument being moved to an operating position.

Referring to FIGS. 1 and 2, a writing instrument 1 providing illumination includes a penholder 11, a pen core 12 with a tip (not labeled) which can be extended out of the pen holder 11 for writing or retracted into the penholder 11 when not use. The writing instrument 1 further includes a rotating plate 13 and a solid state lighting source module 14. The rotating plate 13 can rotate to a specific angle. Also referring to FIGS. 3 and 4, a plate connector 18 is at a top end of the penholder 11. The solid state lighting source module 14 is mounted on the rotating plate 13. A power source module (not shown) is arranged inside the penholder 11 providing power to the solid state lighting source module 14. The power source module can utilize a battery.

Figure 3:
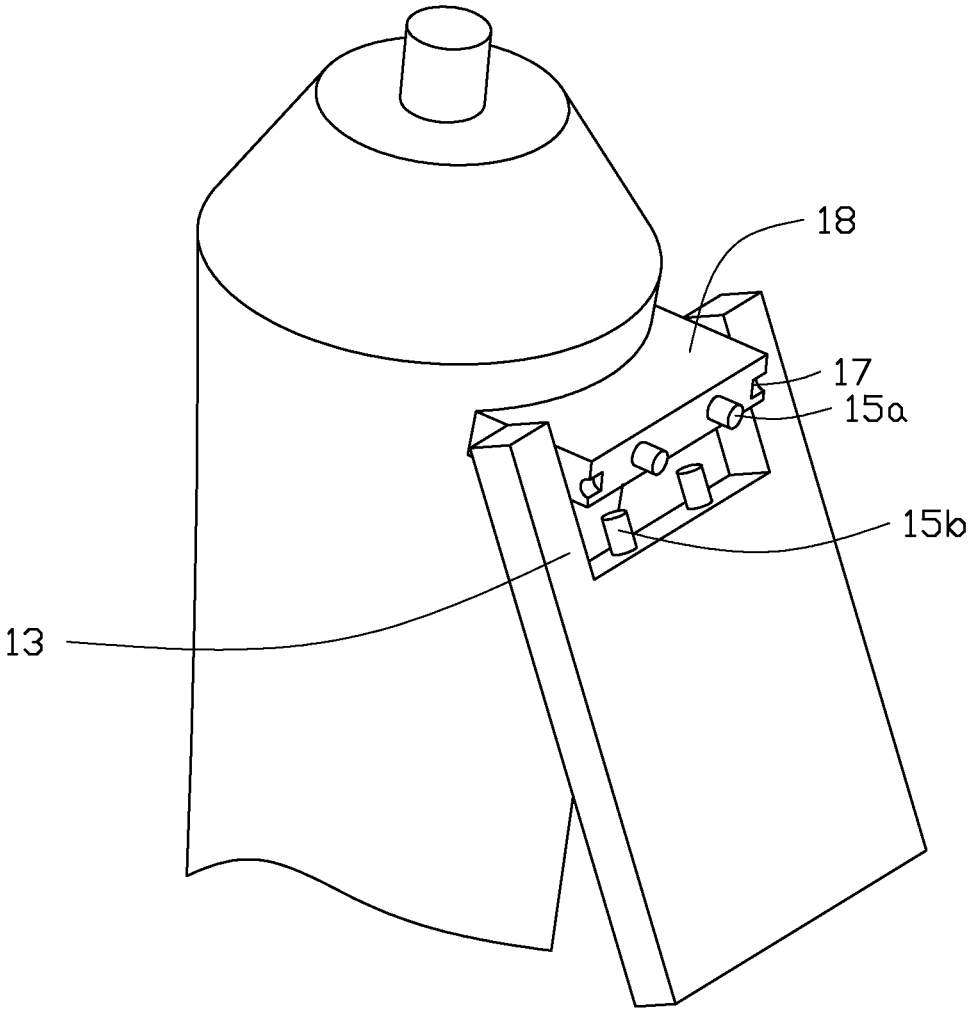
FIG. 3 is an enlarged view of an upper portion of the writing instrument of FIG. 1, wherein the solid state lighting source module is not in use.
Figure 4:
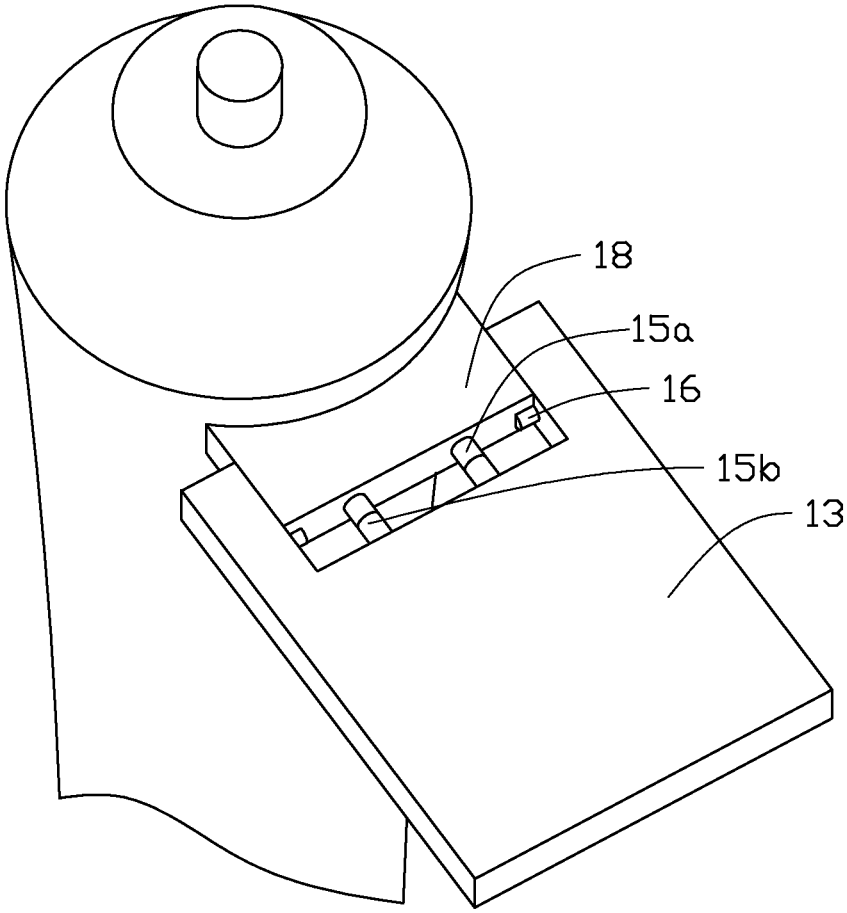
FIG. 4 is an enlarged view of an upper portion of the writing instrument of FIG. 2.

Particularly referring to FIGS. 3 and 4, the plate connector 18 at the top end of the penholder 11 includes at least one first metal electrode 15*a* and two recesses 17. The rotating plate 13 includes at least one second metal electrode 15*b* and two fasteners 16. When the rotating plate 13 is parallel to the penholder 11, the at least one second metal electrode 15*b* of the rotating plate 13 and the at least one first metal electrode 15*a* of the plate connector 18 do not contact each other. Thus, the first metal electrodes 15*a* and the second metal electrodes 15*b* are not electrically conductively connected together, and there is no power provided to the solid state lighting source module 14. At this position, the rotating plate 13 is at an angle with respect to the plate connector 18. The rotating plate 13 is positioned adjacent and substantially parallel to the penholder 11.

Referring to FIG. 4, when the rotating plate 13 is perpendicular to the penholder 11, the second metal electrodes 15*b* of the rotating plate 13 contact the first metal electrodes 15*a* of the plate connector 18, and the solid state lighting source module 14 is turned on. At this position, the rotating plate 13 is coplanar with the plate connector 18. The two fasteners 16 are received in the two recesses 18 to hold the solid state lighting source module 14 at the operating position.

The penholder 11 and the rotating plate 13 can be metal, polymer, or thermosetting material.

The solid state lighting source module 14 can be a light emitting diode (LED), organic light emitting diode (OLED), or laser.

While the disclosure has been described by way of example and in terms of exemplary embodiment, it is to be understood that the disclosure is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A writing instrument providing illumination, comprising a penholder, a pen core, a power source module, a rotating plate, and a solid state lighting source module, the pen core and the power source module arranged in the penholder and the rotating plate connected to one end of the penholder by a plate connector with the solid state lighting source module mounted on the rotating plate, wherein when the rotating plate is rotated to a first position, the solid state lighting source is turned on and when the rotating plate is rotate to a second position different from the first position the solid state lighting source is turned off, and wherein when the rotating plate is perpendicular to the penholder, the rotating plate is at the first position and the at least one second metal electrode of the rotating plate contacts the at least one first metal electrode of the plate connector, whereby the solid state lighting source module is turned on, and the two fasteners are received in the two recesses to hold the rotating plate at the first position.

2. The writing instrument providing illumination of claim 1, wherein the penholder and the rotating plate are metal, polymer, or thermosetting material.

3. The writing instrument providing illumination of claim 1, wherein the solid state lighting source module is a light emitting diode (LED), organic light emitting diode (OLED), or laser.

4. The writing instrument providing illumination of claim 1, wherein the rotating plate comprises at least one second metal electrode and two fasteners.

5. The writing instrument providing illumination of claim 1, wherein the plate connector comprises at least one first metal electrode and two recesses.

6. The writing instrument providing illumination of claim 1, wherein at the first position, the rotating plate is coplanar with the plate connector.

7. The writing instrument providing illumination of claim 1, wherein at the second position, the rotating plate is at an angle with respect to the plate connector.

8. The writing instrument providing illumination of claim 1, wherein when the rotating plate is moved from the first position to the second position, the rotating plate is moved from the position perpendicular to the penholder to a position adjacent to the penholder.

* * * * *